US009212451B2

(12) United States Patent
Sherrill

(10) Patent No.: US 9,212,451 B2
(45) Date of Patent: Dec. 15, 2015

(54) TWO LEVEL ELECTRIC RESISTANCE HEATER AND METHOD OF USE

(75) Inventor: James Lee Sherrill, Cookeville, TN (US)

(73) Assignee: TUTCO, INC., Cookeville, TN (US)

( * ) Notice: Subject to any disclaimer, the term of this patent is extended or adjusted under 35 U.S.C. 154(b) by 887 days.

(21) Appl. No.: 13/344,915

(22) Filed: Jan. 6, 2012

(65) Prior Publication Data

US 2012/0180334 A1 Jul. 19, 2012

Related U.S. Application Data

(60) Provisional application No. 61/433,637, filed on Jan. 18, 2011.

(51) Int. Cl.

| | |
|---|---|
| ***F26B 25/06*** | (2006.01) |
| ***D06F 58/26*** | (2006.01) |
| ***F24H 9/18*** | (2006.01) |
| ***F24H 3/04*** | (2006.01) |
| *H05B 3/36* | (2006.01) |

(52) U.S. Cl.

CPC ..... *D06F 58/26* (2013.01); *F24H 3/0405* (2013.01); *F24H 9/1863* (2013.01); *F24H 2250/02* (2013.01); *H05B 3/36* (2013.01)

(58) Field of Classification Search

CPC ..... H05B 3/36; F24H 2250/02; F24H 9/1863; F24H 3/0405

USPC ..... 34/235; 219/388, 390, 520, 537, 539; 439/162

See application file for complete search history.

(56) References Cited

U.S. PATENT DOCUMENTS

| | | | | |
|---|---|---|---|---|
| 4,845,345 | A * | 7/1989 | Ohnmacht | 219/546 |
| 6,621,056 | B2 | 9/2003 | Sherrill | |
| 8,463,113 | B2 * | 6/2013 | Hwang | 392/350 |
| 8,629,377 | B2 * | 1/2014 | Forget | 219/461.1 |

FOREIGN PATENT DOCUMENTS

| | | |
|---|---|---|
| CN | 1537993 | 10/2004 |
| CN | 101307547 | 11/2008 |
| CN | 101575796 | 11/2009 |
| CN | 102071564 | 5/2011 |
| WO | 2010/114332 | 10/2010 |

* cited by examiner

*Primary Examiner* — Kenneth Rinehart
*Assistant Examiner* — Gajanan M Prabhu
(74) *Attorney, Agent, or Firm* — Clark & Brody

(57) ABSTRACT

An electrical resistance heater assembly includes a heater housing forming a channel having a longitudinal axis for a fluid such as air to pass through and a heater support plate forming first and second levels in the heater housing. A first mica board assembly supporting a ribbon heater is mounted to the heater support plate at the first level and a second mica board assembly supporting a ribbon heater is mounted to the heater support plate at the second level. The first level is positioned adjacent an inlet of the heater housing and the second level is positioned adjacent an outlet of the heater housing. The first level and a side of the heater housing form a passageway for air to enter the heater housing and be directed to the ribbons of the second level, thereby allowing air to bypass the heater ribbons of the first level.

13 Claims, 14 Drawing Sheets

TWO LEVEL ELECTRIC RESISTANCE HEATER AND METHOD OF USE

This application claims priority under 35 USC 119(e) based on application No. 61/433,637, filed on Jan. 18, 2011.

FIELD OF THE INVENTION

The present invention relates to an improved electrical resistance heater design, and particularly one having two levels to improve heater performance.

BACKGROUND ART

The use of electrical resistance heaters to heat air or other fluids is well known in the prior art. For clothes dryers, it is common to use helical coils of resistance wire to provide the heated air for drying purposes. FIGS. 12 and 13 show a prior art clothes dryer 100 with a heater duct 101, which is normally vertically aligned with respect to the dryer drum axis, and a heater 103, which is generally horizontally aligned with the dryer drum axis. The heater duct 101 has an opening 105, which interfaces with an opening in the dryer drum to supply heater air. The other end of the heater duct has another opening 107 that receives an end of the heater 103. Although not shown, there is also structure to support the heater 103, a heat shield and the necessary fasteners, etc. to connect the components together. These types of heaters are generally the FIG. 8 helical coil type, which includes an upper and lower coil. This construction is well known in the art and a further description thereof is not needed.

Electrical resistance heaters employing ribbons for heating instead of wires is also known.

While a number of different heater configurations have been proposed for clothes dryers, there are still problems in terms of heater short circuiting, excessive temperatures of the heater causing problems for materials of construction and the need to reduce costs.

The present invention responds to these needs by providing an electric resistance ribbon heater that operates at lower temperature, is lower in cost, provides an improved way to turn the heater ribbon, and provides a better application than the current heater configurations for clothes dryers.

SUMMARY OF THE INVENTION

One object of the invention is to provide an improved electrical resistance heater assembly and method of use thereof.

In one embodiment, the electrical resistance heater assembly comprises a heater housing forming a channel having a longitudinal axis for a fluid such as air to pass through. A heater support plate is provided that forms first and second levels in the heater housing. A first mica board assembly is mounted to the heater support plate at the first level and a second mica board assembly is mounted to the heater support plate at the second level. Each mica board assembly supports a heater ribbon running in a looped configuration along rows that are generally perpendicular to the longitudinal axis of the channel. Adjacent rows terminate in a plurality of openings that are configured to turn the ribbon 180 degrees for travel from one row to an adjacent row.

The first level is positioned adjacent an inlet of the heater housing and the second level is positioned adjacent an outlet of the heater housing. The first level and a side of the heater housing form a passageway for air to enter the heater housing and be directed to heater ribbons of the second level without having to pass over heater ribbons of the first level. That is, the second level ribbon is downstream from the first level ribbon with respect to the direction of fluid flow, which means that it is not underneath the first level ribbons as is commonly found in the prior art designs.

The plurality of openings found in each of the mica board assemblies comprise a pair of first openings and a second opening. Each first opening has a first face that is generally perpendicular to an axis of a row of the mica board assembly and a second face that is aligned generally 45 degrees from the axis. The second opening has opposing faces, each opposing face aligned generally 45 degrees from the axis of the row.

The heater support plate can have a first plate portion that forms the second level and a pair of flanged legs extending from the heater support plate to form the first level and a portion of the passageway.

The first and second levels can each have their own heater ribbon, with the heater ribbons connected in parallel.

The electric resistance heater is particularly adapted for use in a clothes dryer. In one embodiment, the clothes dryer can include a dryer drum having a generally horizontal axis and a vent to allow heated air to enter the dryer drum for drying purposes. The inventive heater assembly can be mounted adjacent the dryer drum in a vertical orientation and having a channel to receive air to heat. A heating duct can be arranged in a generally vertical orientation between an outlet of the heater assembly and the vent to direct heated air from the heater assembly to the dryer drum.

The electrical resistance heater can be used to heat any fluid, but air for a clothes dryer is a preferred fluid for heating.

Another aspect of the invention involves a unique configuration of the mica boards used in an electrical resistance ribbon heater assembly. Typically, mica boards are provided with openings to support and arrange a heater ribbon for heating a fluid, wherein the ribbon travels along a first path on the mica board and must turn 180 degrees to follow a second path generally parallel to the first path. According to the invention, a unique turn configuration in the mica board for the 180 degree turn at the end of a row of openings of the first path is provided. This configuration comprises a pair of first openings and a second opening. Each first opening has a first face that is generally perpendicular to an axis of the row and a second face that is aligned generally 45 degrees from the axis. The second opening has opposing faces, each opposing face aligned generally 45 degrees from the axis of the row. The combination of the first openings with the second opening allows the ribbon to turn 180 degrees once the ribbon reaches the end of the path of a given row and needs to turn to travel along an adjacent row in the mica board assembly.

DETAILED DESCRIPTION OF THE DRAWINGS

FIG. 1*a* is shows a top view of a heater subassembly in a bottom housing of the inventive heater.

FIG. 1*b* shows a front view of the heater subassembly of FIG. 1*a*.

FIG. 1*c* shows a side view of the heater subassembly of FIG. 1*a*.

FIG. 2*a* shows a top view of a housing bottom of the heater of the invention.

FIG. 2*b* shows a front view of the housing bottom of FIG. 2*a*.

FIG. 2*c* shows a rear view of the housing bottom of FIG. 2*a*.

FIG. 2*d* shows a side view of the housing bottom of FIG. 2*a*.

FIG. 3*a* shows a top view of a housing top of the heater of the invention.

FIG. 3*b* shows a front view of the housing top of FIG. 3*a*.

FIG. 3*c* shows a rear view of the housing top of FIG. 3*a*.

FIG. 3*d* shows a side view of the housing top of FIG. 3*a*.

FIG. 4*a* shows a first one of mica boards of the inventive heater.

FIG. 4*b* shows a second one of mica boards of the inventive heater.

FIG. 4*c* shows a third one of mica boards of the inventive heater.

FIG. 4*d* shows a fourth one of mica boards of the inventive heater.

FIG. 4*e* shows an enlarged view of the openings in the heater of FIG. 4*a*.

FIG. 5*a* shows a top view of a heater subassembly shown in FIG. 1*a*.

FIG. 5*b* shows a front view of the heater subassembly of FIG. 5*a*.

FIG. 5*c* shows a side view of the heater subassembly of FIG. 5*a*.

FIG. 6*a* shows a top view of a heater support plate of the inventive heater.

FIG. 6*b* shows a top view of the heater support plate of FIG. 6*a* prior to bending of certain components thereof.

FIG. 6*c* shows a side view of the heater support plate of FIG. 6*a*.

FIG. 6*d* shows a front view of the heater support plate of FIG. 6*a*.

FIG. 7*a* shows a top view of the inventive heater with housing top and bottom connected together.

FIG. 7*b* shows a front view of the heater of FIG. 7*a*.

FIG. 7*c* shows a rear view of the heater of FIG. 7*c*.

FIG. 7*d* shows a side view of the heater of FIG. 7*a*.

Figure 16A:
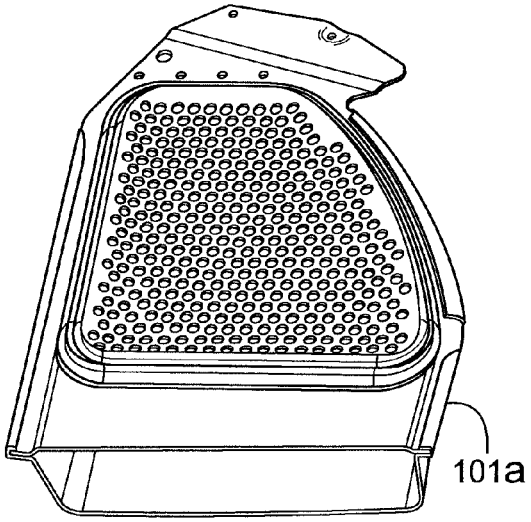
Figure 16B:
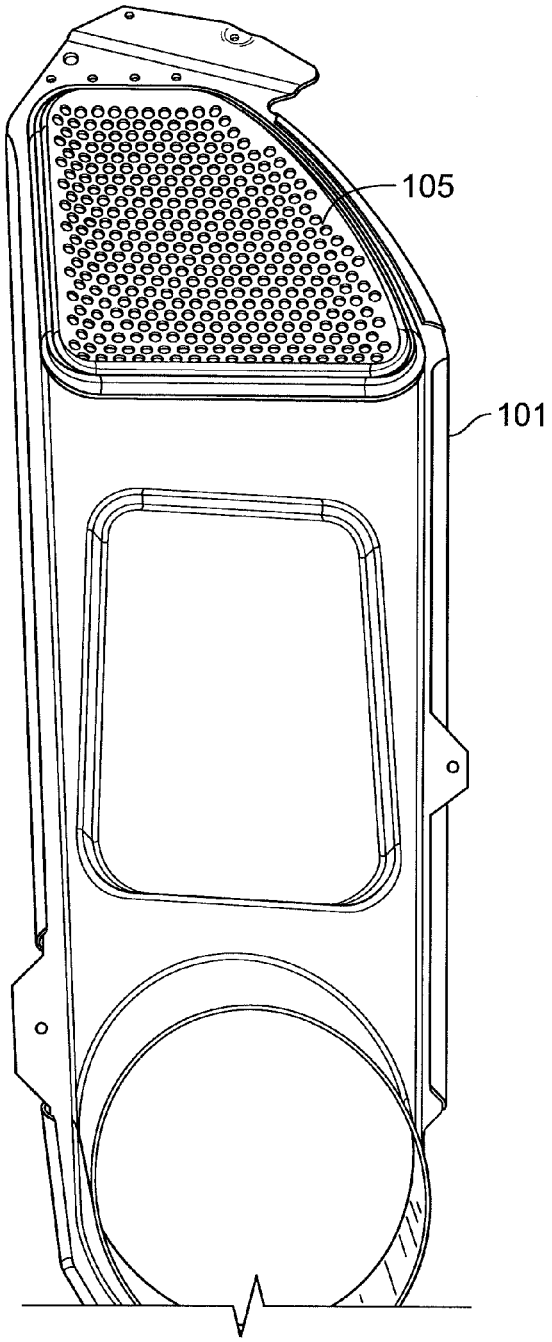

FIGS. 16*a* and 16*b* compare heater duct for use with the inventive heater and prior art heater ducts.

DESCRIPTION OF THE PREFERRED EMBODIMENTS

Figure 1A:
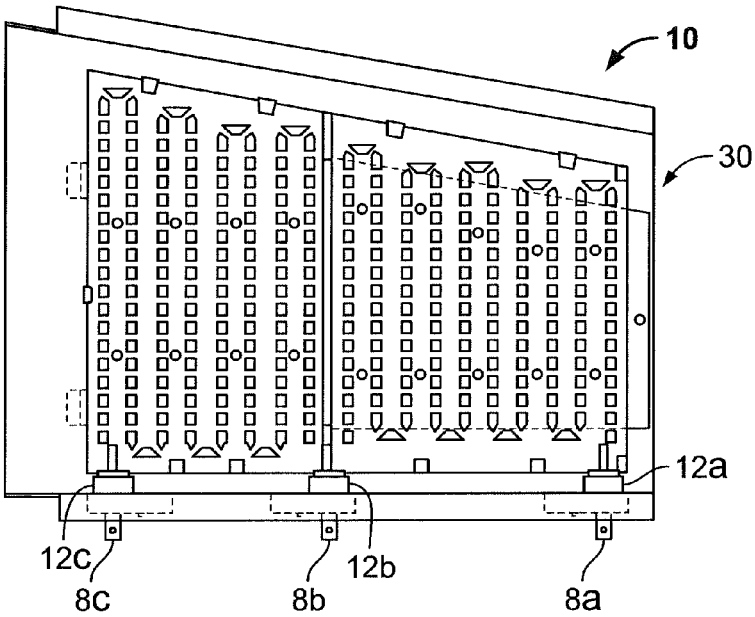
Figure 1B:
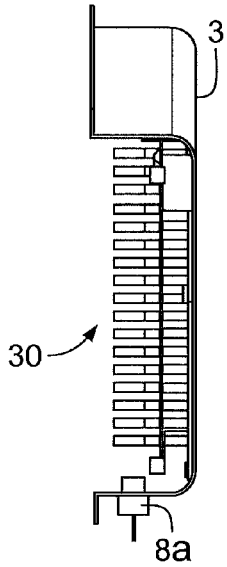
Figure 1C:
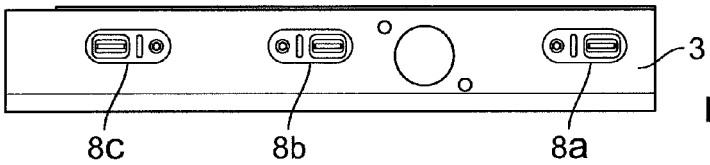

FIGS. 1*a*-*c* show a heater assembly 10 with the top of a heater housing 1 removed to show a heater subassembly 30 in the housing 1.

Referring first to FIGS. 2*a*-3*d*, the heater housing 1 of the assembly 10 comprises a housing bottom 3 and a housing top 5, with the top and bottom configured to attach together to form a channel 4 with opposing open ends to allow air to flow through the channel.

Figure 10:
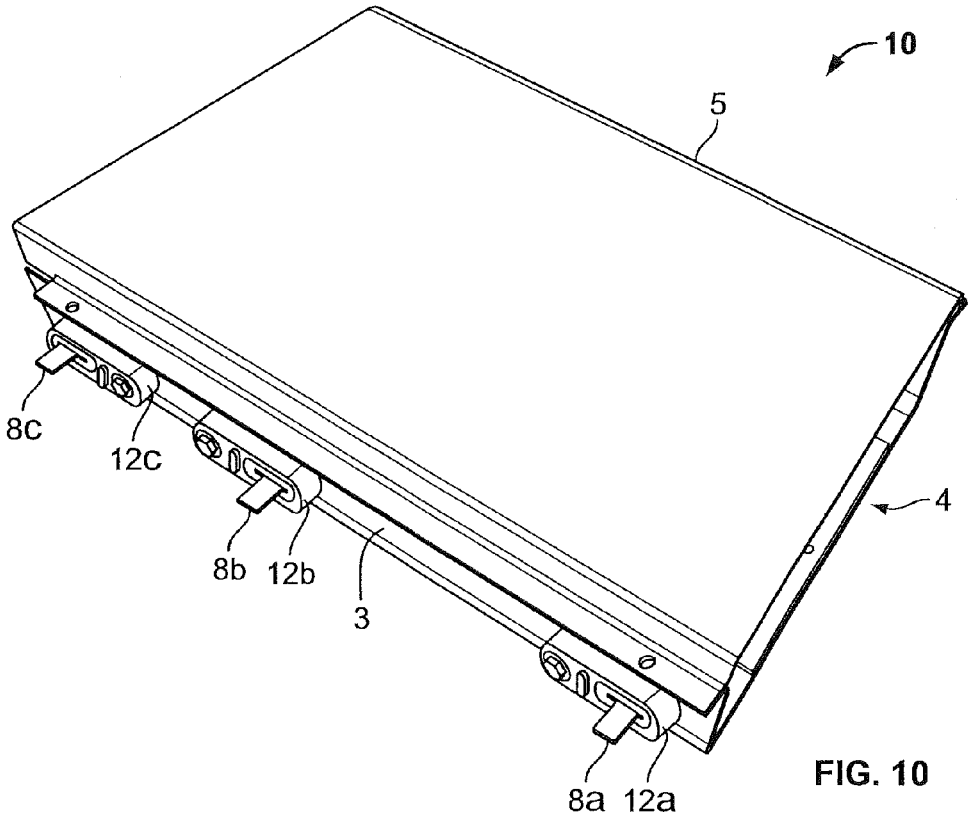
FIG. 10 shows a perspective view of an assembled heater of the invention.

FIG. 10 shows a perspective view of the heater assembly 10 showing the top and bottom housings 3 and 5, terminals 8*a*, 8*b*, 8*c* and insulators 12*a*, 12*b*, 12*c*. Again, the entry channel for air is shown as reference numeral 4.

Figure 9:
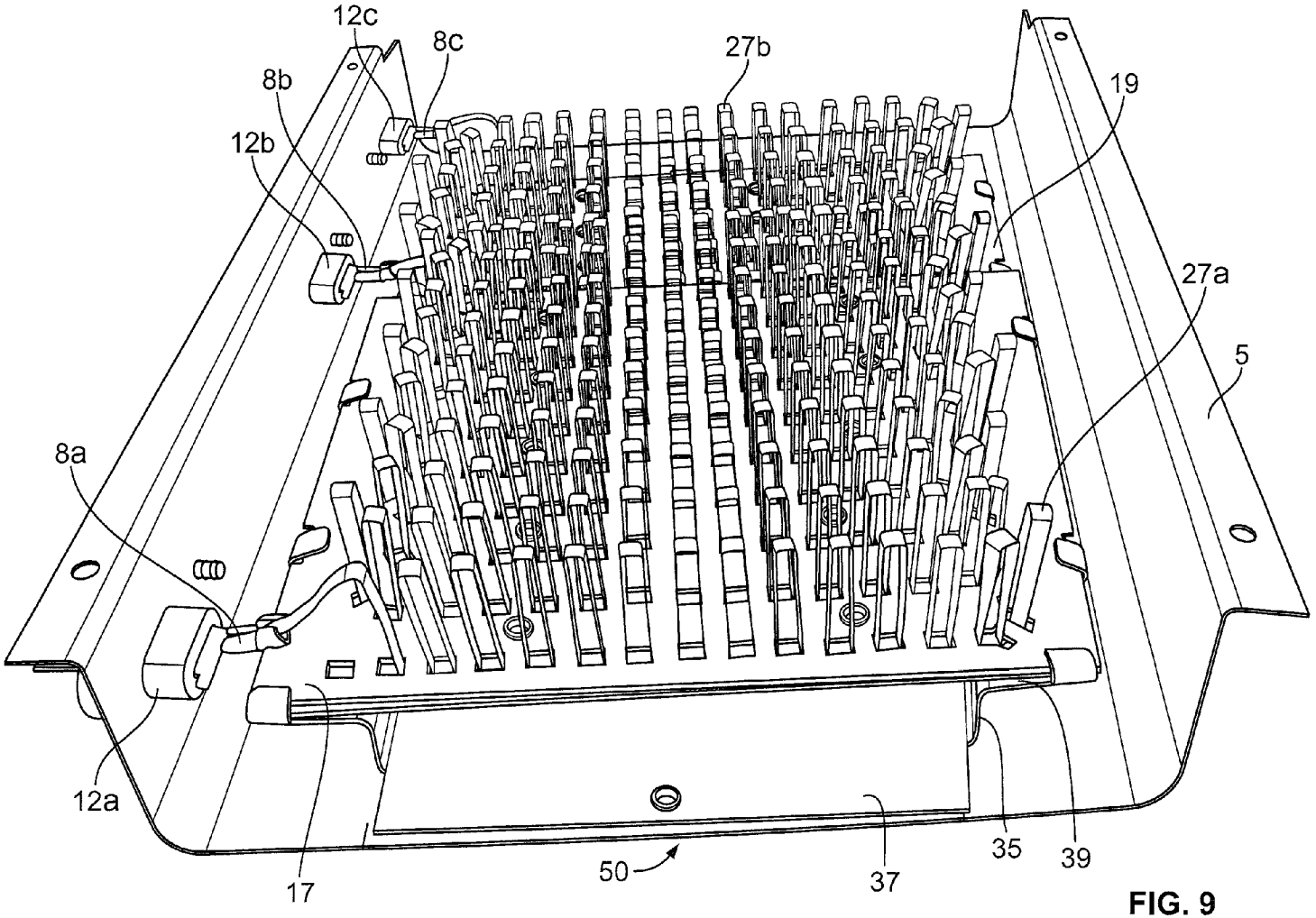
FIG. 9 shows a perspective view of the heater subassembly of FIG. 1*a* in the housing bottom of the inventive heater.

Referring back to FIGS. 2*a*-3*d*, one side 7 of the bottom 3 includes openings 9 for mounting of terminals 8*a*, 8*b*, and 8*c*, and insulators 12*a*, 12*b*, and 12*c*, see FIGS. 1*c* and 9, to provide power to heater elements for the heater subassembly 30 mounted in housing 1 of the heater 10.

The housing 1 can have any configuration. A preferred configuration is shown in FIGS. 1*a* to 2*d*, wherein one side of the housing 1 is angled with respect to the other side to facilitate use in a clothes dryer. In this embodiment, the heater inlet would be the end 6 that is smaller in cross sectional area than the heater outlet. However, the heater outlet could be smaller than the inlet if so desired. In fact, the configuration of the heater housing can have virtually any shape to provide the desired heater fluid flow to a particular location. One example of a heater with different inlet and outlet sizes is U.S. Pat. No. 6,621,056, which is incorporated by reference in its entirety.

The housing top 5 and bottom 3 have flanges 11 and 13 respectively, the flanges configured to mate with each other when the top 5 and bottom 3 are attached.

Figure 2A:
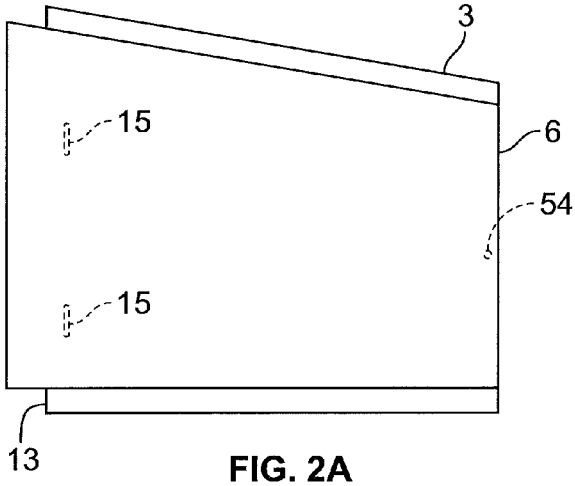
Figure 2B:
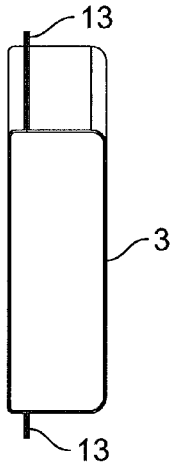
Figure 2C:
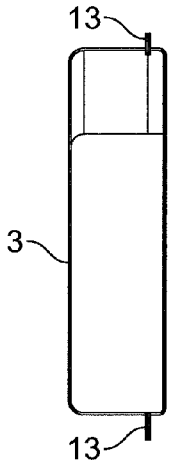
Figure 2D:
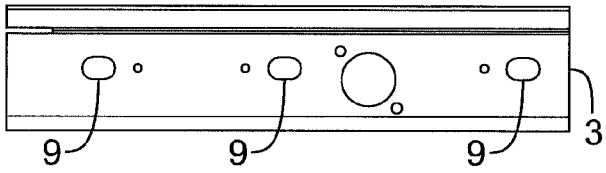
Figure 3A:
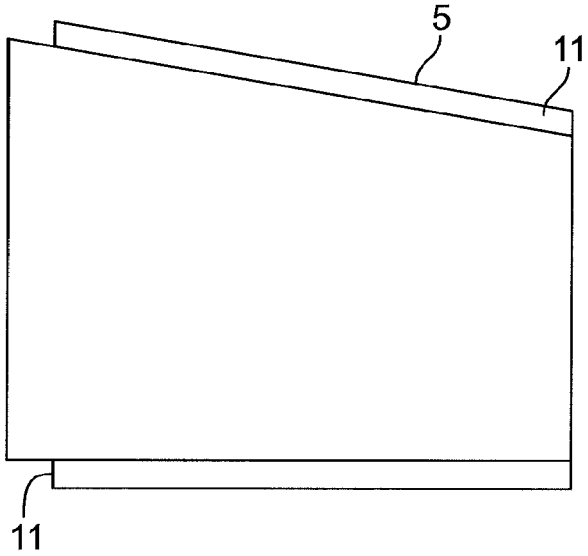
Figure 3B:
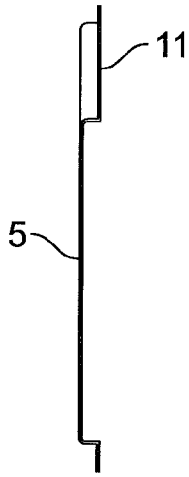
Figure 3C:
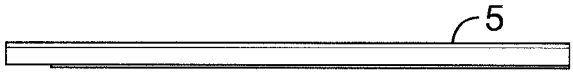
Figure 3D:
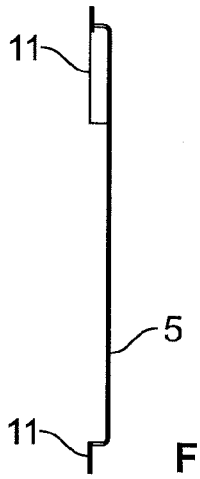

The housing bottom 3 also includes a pair of slits 15, see FIG. 2*a*, which cooperate with a heater subassembly plate for plate mounting as explained below.

The heater subassembly 30 shown in FIGS. 1*a*-1*c* is made up of a heater support plate, mica boards, and one or more electric resistance heating ribbons. The mica boards are shown in FIGS. 4*a*-*d*. Four mica boards 17, 19, 21, and 23 are shown. Boards 17 and 19 have openings 51 to allow travel of a heating ribbon along the row 53 in the board 17. Board 21 is designed to fit underneath board 17 to provide insulation against the portion of the ribbon (not shown) on the underside of board 17. Similarly, board 23 protects and insulates the ribbon portion exposed on the underside of board 19. The boards 17 and 21 are attached together as are the boards 19 and 23 using fasteners or the like. In the illustrated embodiment, the boards have openings 25 that allow fastening using a rivet or other fastening means. The boards are configured to match the angular configuration of the housing 1 as shown in FIGS. 1 and 2.

FIGS. 5*a*-6*d* show the heater subassembly 30 with the heater ribbon 27 and support plate 29. The support plate 29, see FIGS. 6*a*-6*d*, has a two level configuration. A first level 31, see FIG. 6*b*, is formed by the flanges 33, each of which have one leg 35 extending up from a bottom 37 of the plate 29 and a second leg 39 which is generally parallel to the bottom 37. The second legs 39 provide support for the mica boards 17 and 21. The mica boards are held in place by a number of tabs 41 on the legs 39, with the tabs bent to cinch the boards 17 and 21 to the legs 39.

Figure 6A:
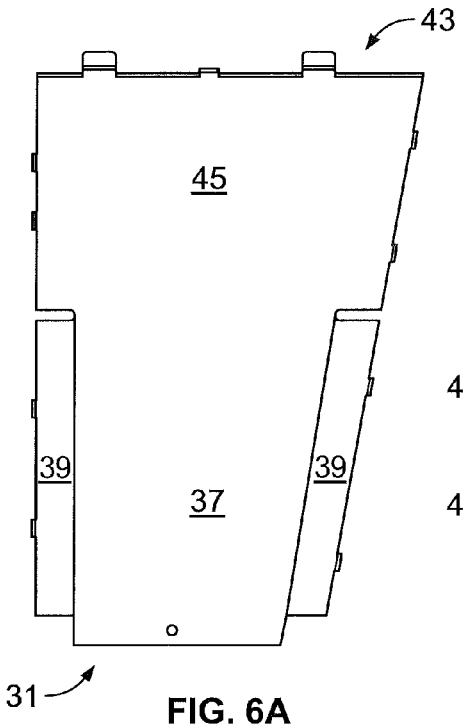
Figure 6B:
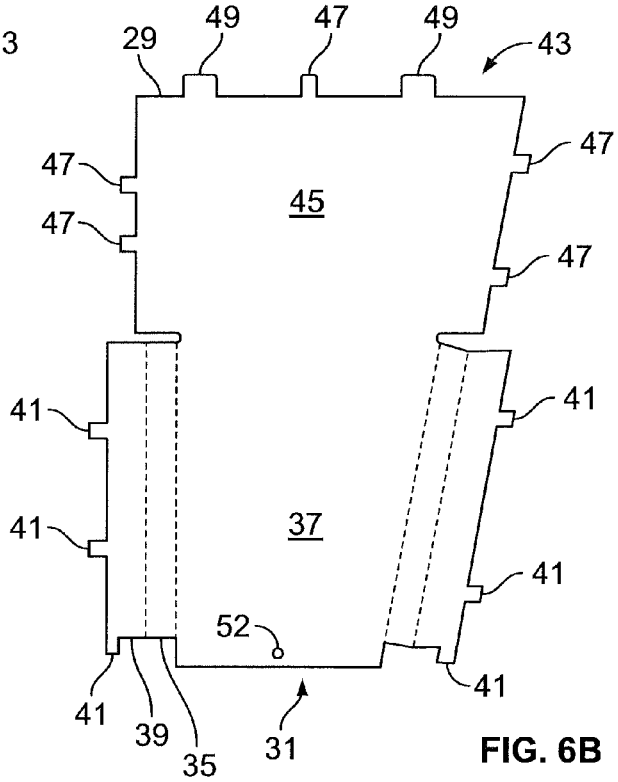
Figure 6C:
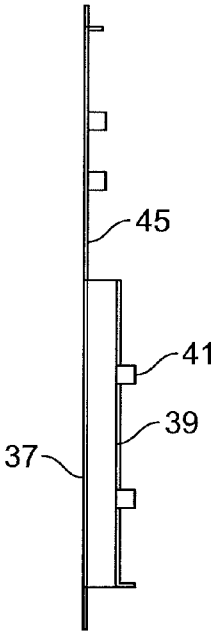
Figure 6D:
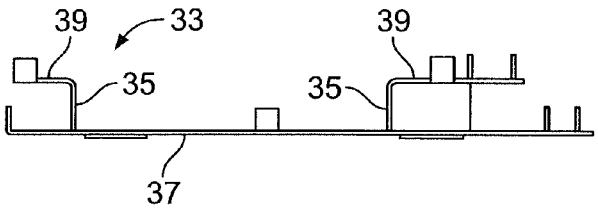
Figure 7A:
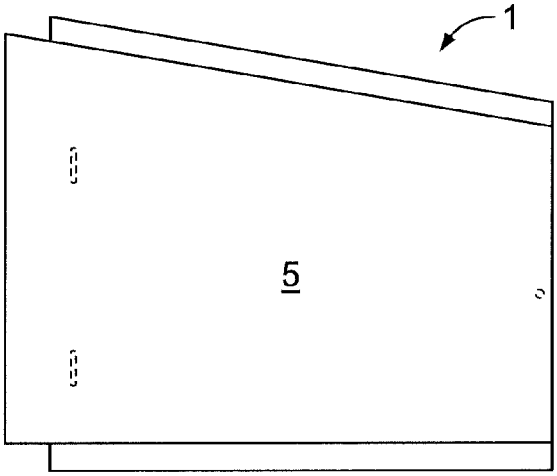
Figure 7B:
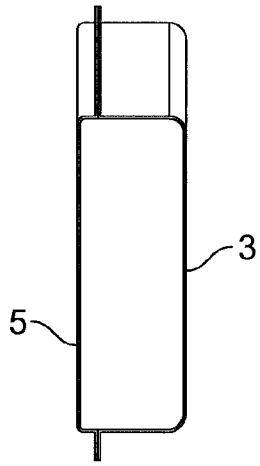
Figure 7C:
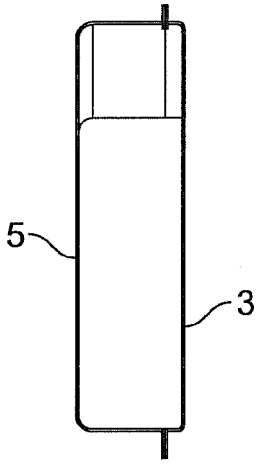
Figure 7D:
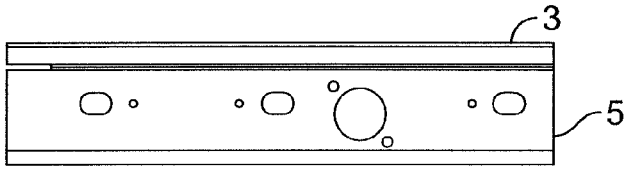

A second and lower level 43 of the heater subassembly, see FIG. 6*b*, is formed by a portion 45 of bottom 37. The mica boards 19 and 23 rest on portion 45 and are secured in place using the tabs 47.

The bottom 37 also has a pair of tabs 49, which are designed to interface with the slits 15 in the housing bottom 3, see FIG. 1*a*, to secure the plate 29 in place. The bottom 37 also has an opening 52 so that the end opposite that containing the tabs 49 can be secured to the bottom 3 of the housing a fastener or the like. The bottom 3 has a corresponding opening 54 for this purpose, see FIG. 1*a*.

Figure 5C:
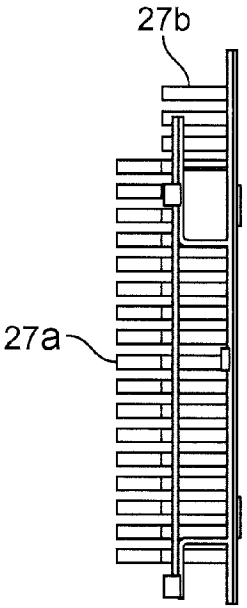
Figure 5A:
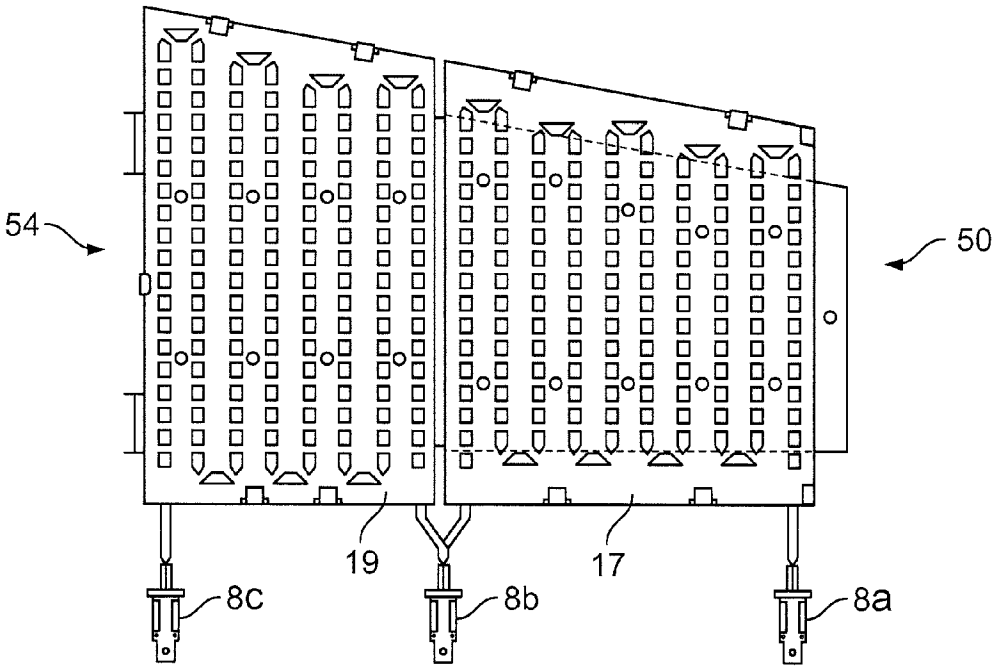
Figure 5B:
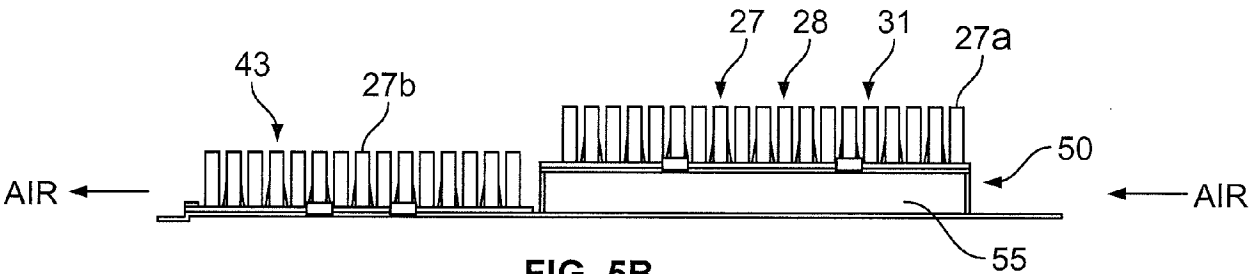

Referring to FIGS. 5*a*-5*d* again and particularly FIG. 5*b*, the ribbon 27 is shown connected in parallel, with one ribbon 27*a* forming an upper heating stage for the first level 31 and a second ribbon 27*b* forming a lower heating stage at level 43. The ribbon 27*a* terminates at terminals 8*a* and 8*b* with ribbon 27*b* terminating at terminals 8*b* and 8*c*.

Referring back to FIGS. 4*a*-4*e*, the mica boards 17 and 19 have a number of openings 51, which allow the ribbon 27 to be looped through the openings and extend upwardly from the boards 17 and 19 for heating purposes. The openings 51 are generally square in shape and run in the row 53 and along an axis A, that is generally perpendicular to the direction of air flow through the heater, which is shown by the "AIR" arrows in FIG. 5*b*.

Figure 4A:
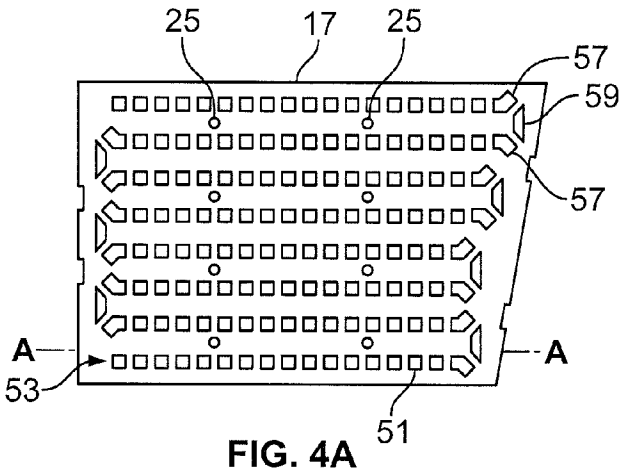
Figure 4B:
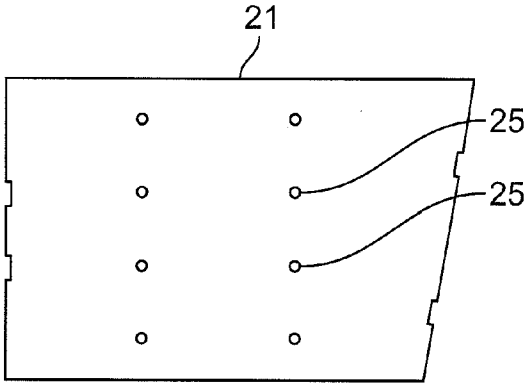
Figure 4C:
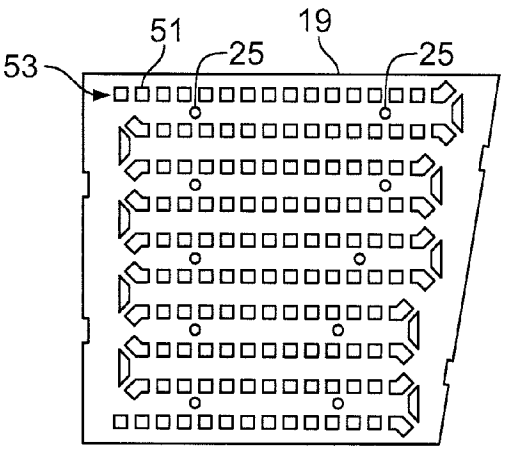
Figure 4D:
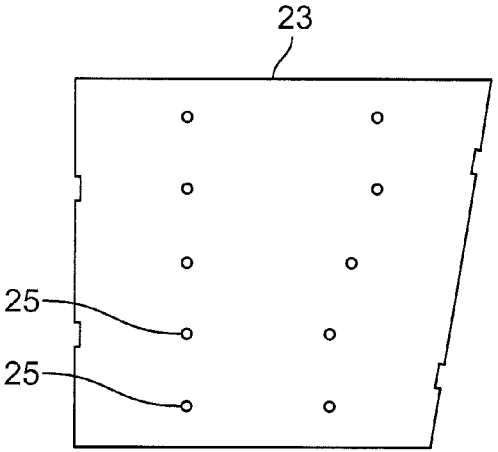
Figure 4E:
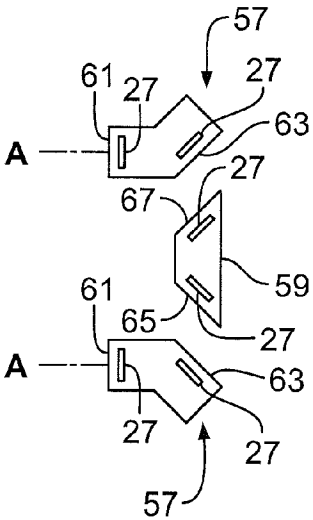

Referring particularly to FIGS. 4*a*, 4*c*, and 4*e*, the boards 17 and 19 also have openings configured in a particular manner to allow the ribbon to turn 180 degrees when one row 53 terminates and then travel along an adjacent row in the opposite direction. The openings designed to allow the ribbon 27 to turn are designated by reference numeral 55 and comprise a pair of first openings 57 and a second opening 59. As shown in the enlarged view of the openings in FIG. 4*e*, the openings 57 are configured with a first face 61 perpendicular to the axis A and a second face set an angle of about 45 degrees with respect to axis A.

The second opening 59 also has a pair of faces 67 and 69. Each of the faces 67 and 69 is generally parallel to an adjacent face 63 of openings 57. The faces 61, 63, 65, and 67 are oriented to minimize the stress imposed on the ribbon when making the 180 degree turn between rows 53. Starting with one of the openings 57 in FIG. 4*e*, the ribbon 27 projects upwardly near or next to the face 61 and extends upwardly in a loop configuration. The ribbon loop twists in a 45 degree angle and is near or next to the face 63 as the ribbon travels under the mica board 17 and through opening 59 to form a second loop. The ribbon loop formed by opening 59 twists 90 degrees by virtue of the configuration of the two faces 65 and 67. The ribbon 27 then travels under the mica board 17 from face 67 and enters opening 57 to twist another 45 degrees according to faces 63 and 61. The ribbon 27 is then aligned with face 61 to travel along an adjacent row and axis A.

While certain sides of the openings 57 and 59 shown in FIG. 4*e* employ straight faces or edges, the opening configuration can be changed providing that the orientation of the faces that interface with the ribbon when looping through the openings is maintained so that the ribbon can turn in the needed 180 degree fashion to travel along adjacent rows. For example, the sides of the openings not in contact with the face of the ribbon could be curved if so desired.

The heater ribbon can be a continuous ribbon that runs along both mica boards 17 and 19 and is terminated on its ends. In the embodiment shown in FIGS. 5*a*-5*c*, each level has its own heater ribbon to form a two stage heater in parallel. Thus, the first level 31 has a heater ribbon 27*a* and the second level 43 has a second ribbon 27*b*, each terminating as described above in FIGS. 5*a*-5*c* using terminals 8*a*-8*c*. In this two stage embodiment, one or both stages can be controlled to be operational, thus giving more flexibility. Taking as an example of each stage designed to deliver 2700 watts, the heater assembly could function as a 2700 or 5400 watt heater. Since the control of such would be within the skill of the art, a further description of the control features is not deemed necessary for understanding of the invention.

Referring back to FIGS. 5*a*-5*d*, air, which is typically drawn through the heater under negative pressure, enters the heater at 50 and exits at 54. Some air immediately passes over the ribbons in level 31 with other air passing beneath the level 31 ribbons in the channel 55. This air, which is essentially unheated, then passes over the ribbons in the second and lower level 43. One advantage of having the ribbons at two different elevations, with the elevation of the ribbons first seeing unheated air being higher than the later ribbon arrangement is that ribbons in level 31 do not see heat from below. In the prior art coil heater, two heating coils would be present, one on top of the other. The underneath coils not only heat the air that passes over them but also contributes to heating the air and coils positioned overhead. This results in higher heating for the overhead coils and problems in heater operation. By having two elevations of ribbons that are spaced from each other along the direction of air flow through the heater, with the first level of ribbons not having an entire set of heater ribbons right next to it as is the case in the prior art heaters, e.g., one set positioned over the other set, the excessive heating occurring in the prior art heaters is avoided.

The arrangement of the two levels of ribbons also creates a thin heating duct arrangement but with a substantial watt loading. For example, the two levels of ribbons could each be designed to deliver 2700 watts so as to form a 5400 watt heater. The two levels means that the ribbon height for each level can be reduced, which means that the ribbon arrangement is made stronger. That is, the greater the height of the ribbons, the more difficult it is for the ribbon length in the ribbon loop to stand up to the heating. For ribbons having a nominal height of ¾ inch, a heater height of 1.25 inches can be achieved without having to use ribbons that are 1.25 inches in height, thus avoiding the problems associated with large height ribbons. Put another way, the heater employs stronger loops without loss of covering the cross sectional area of the duct as much as possible for efficient heat transfer.

Figure 8:
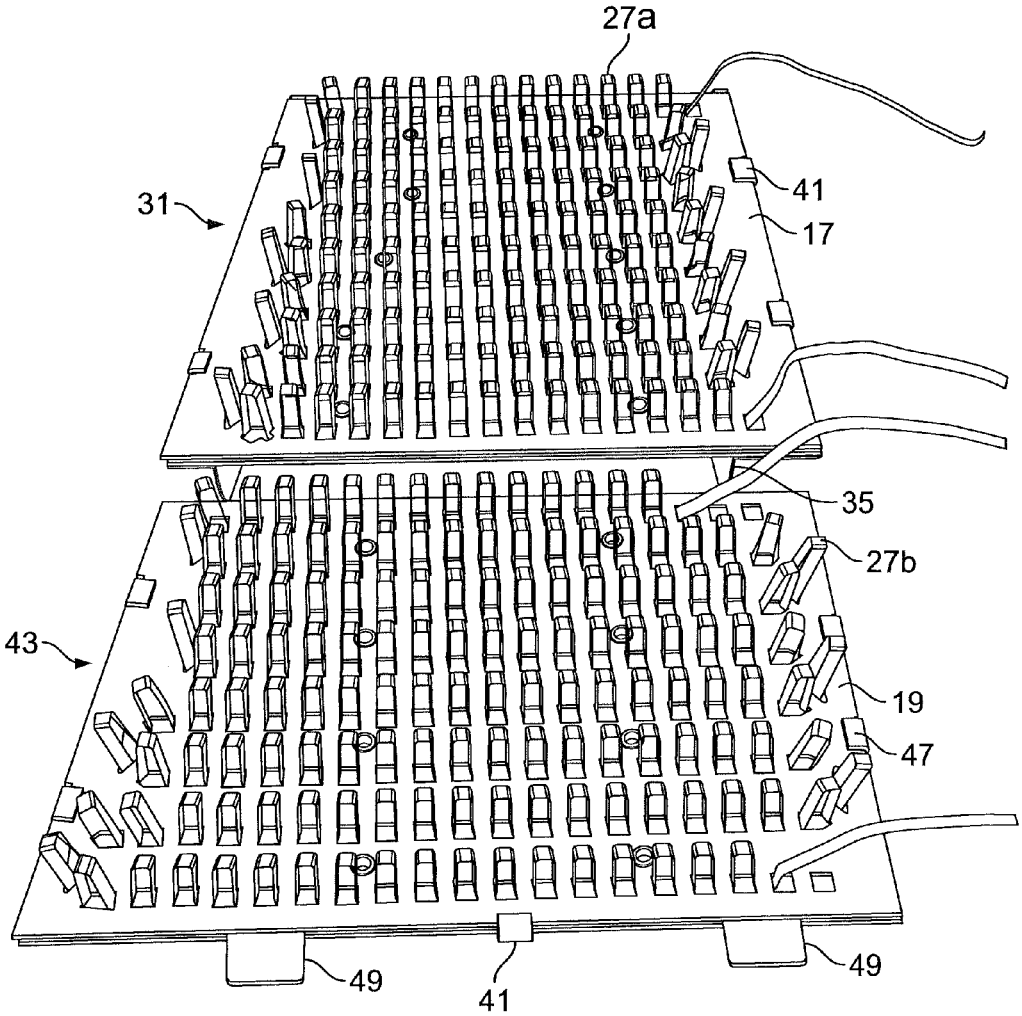
FIG. 8 shows a perspective view of the heater subassembly of FIG. 1*a*.

FIG. 8 shows a perspective view of the heater subassembly 30 showing the mica boards 17/21 and 19/23 mounted on the support plate with FIG. 9 showing the heater subassembly 30 mounted in the housing bottom 3.

Figure 11:
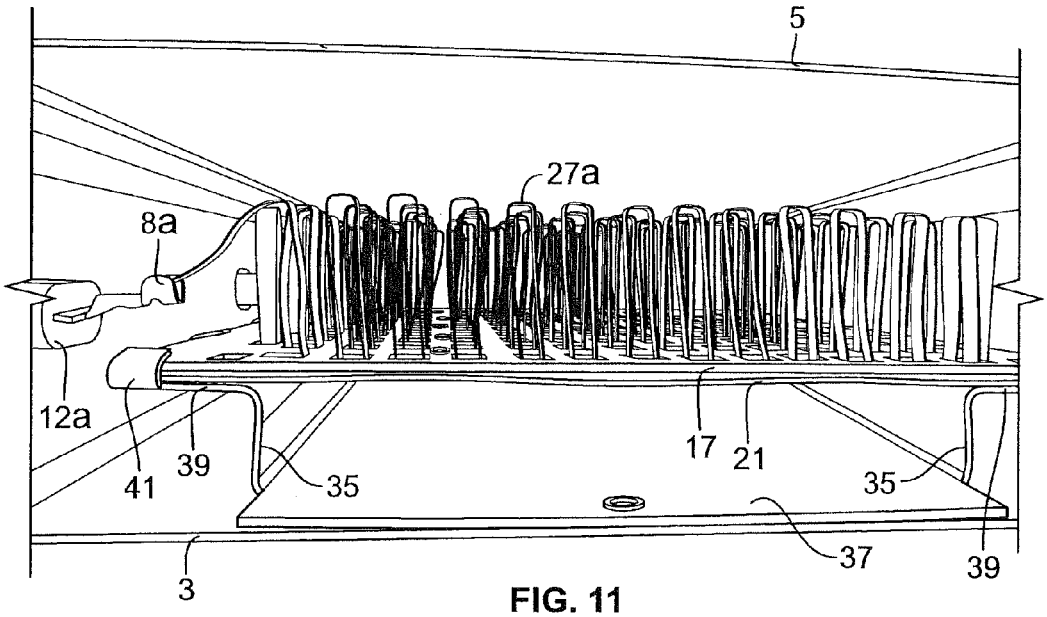
FIG. 11 shows an end view of the heater of FIG. 10.

FIG. 11 shows a front view of the heater showing the first level 31 of heater ribbon and the legs 35 and flanges 39 supporting mica boards 17 and 21 of the first level.

Figure 14:
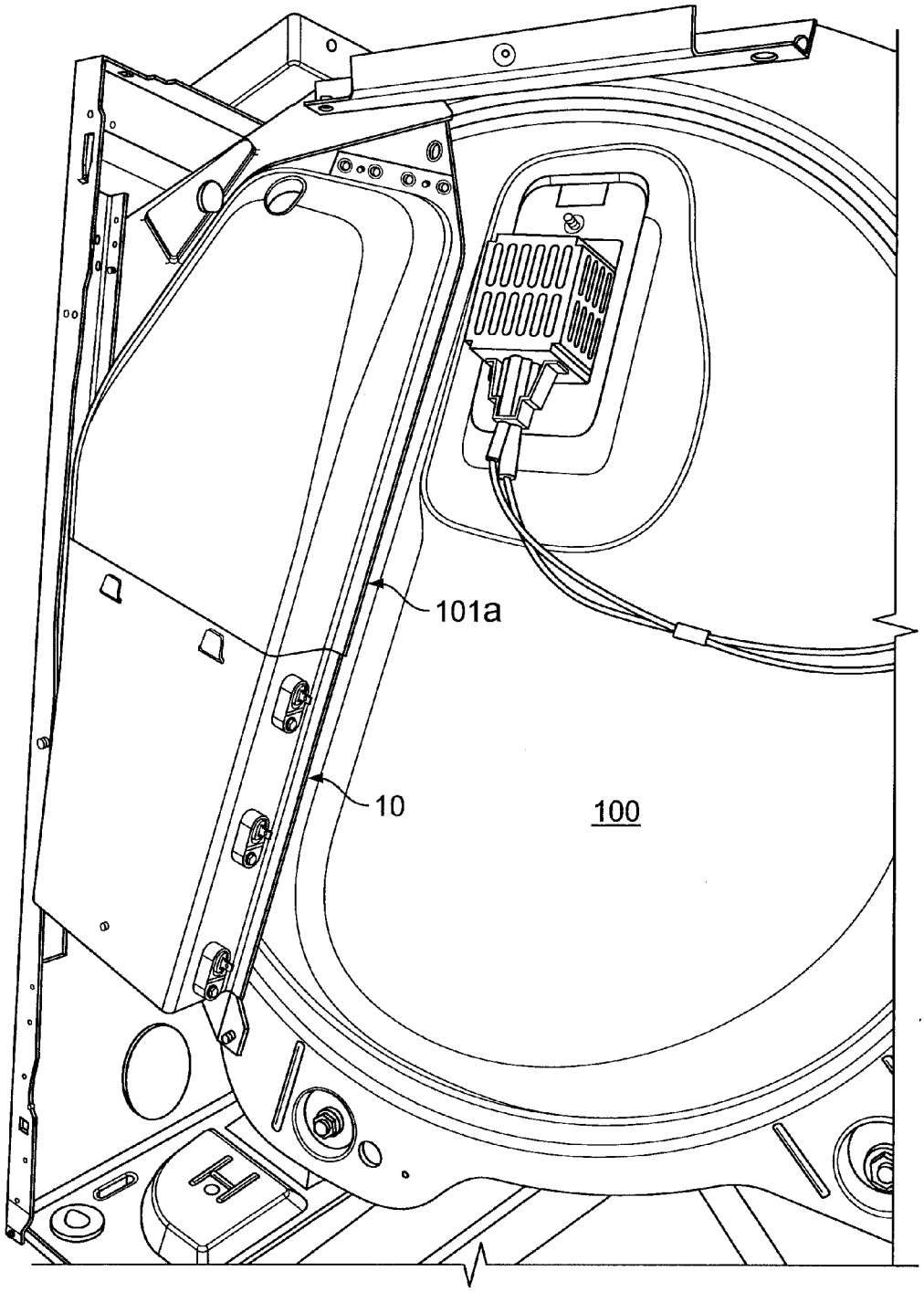
FIG. 14 shows the inventive heater and heater duct in use with a clothes dryer.

FIG. 14 shows one embodiment of the inventive heater assembly with a clothes dryer. The clothes dryer portion 100 is depicted along with the inventive heater 10 and a modified duct 101*a*.

Figure 15:
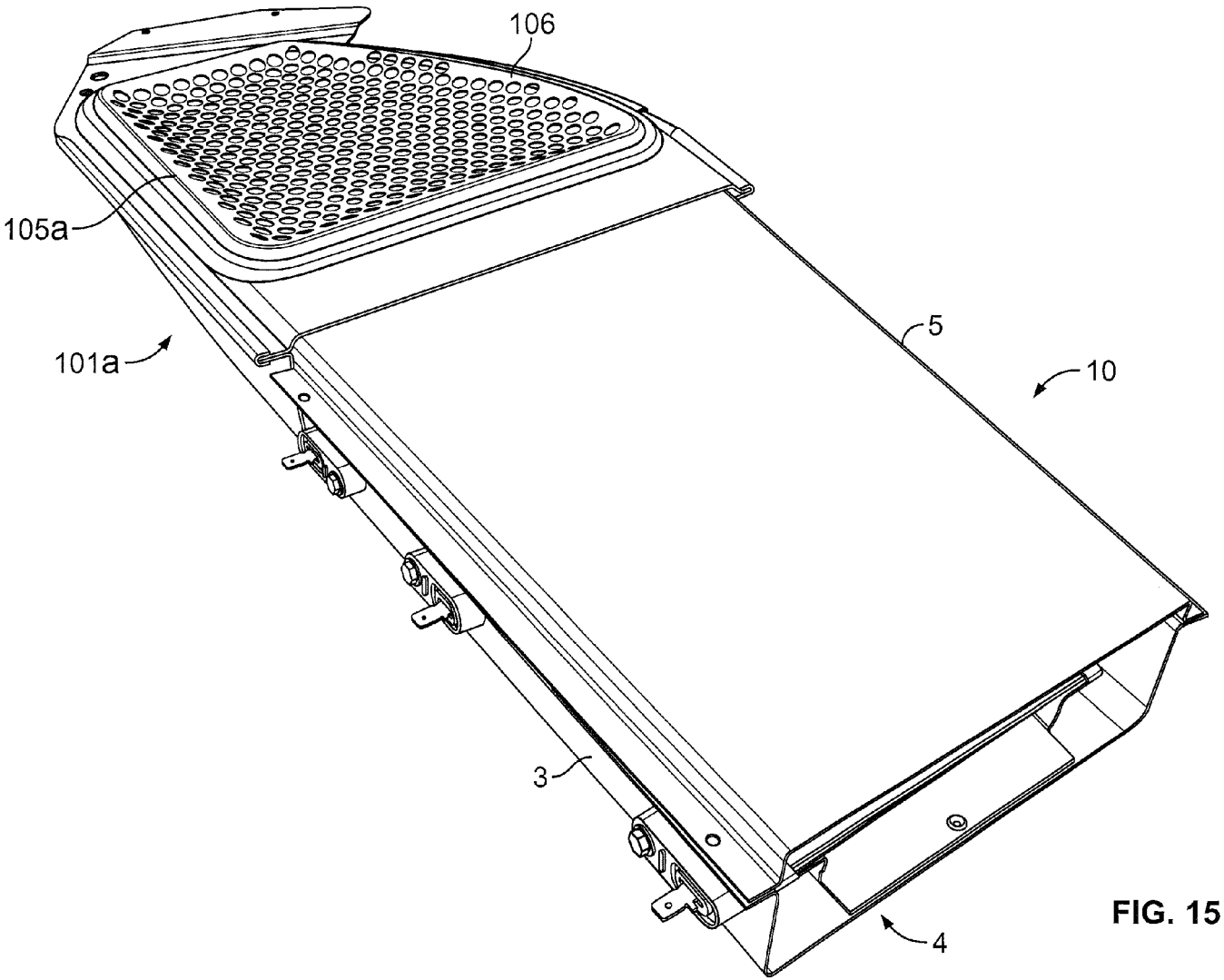
FIG. 15 shows another view of the inventive heater and heater duct of FIG. 14.

FIG. 15 shows the other side of the heater assembly depicted in FIG. 14. The modified duct 101*a* is shown with the openings 105*a* to allow heated air to flow into the dryer for clothes drying.

Figure 12:
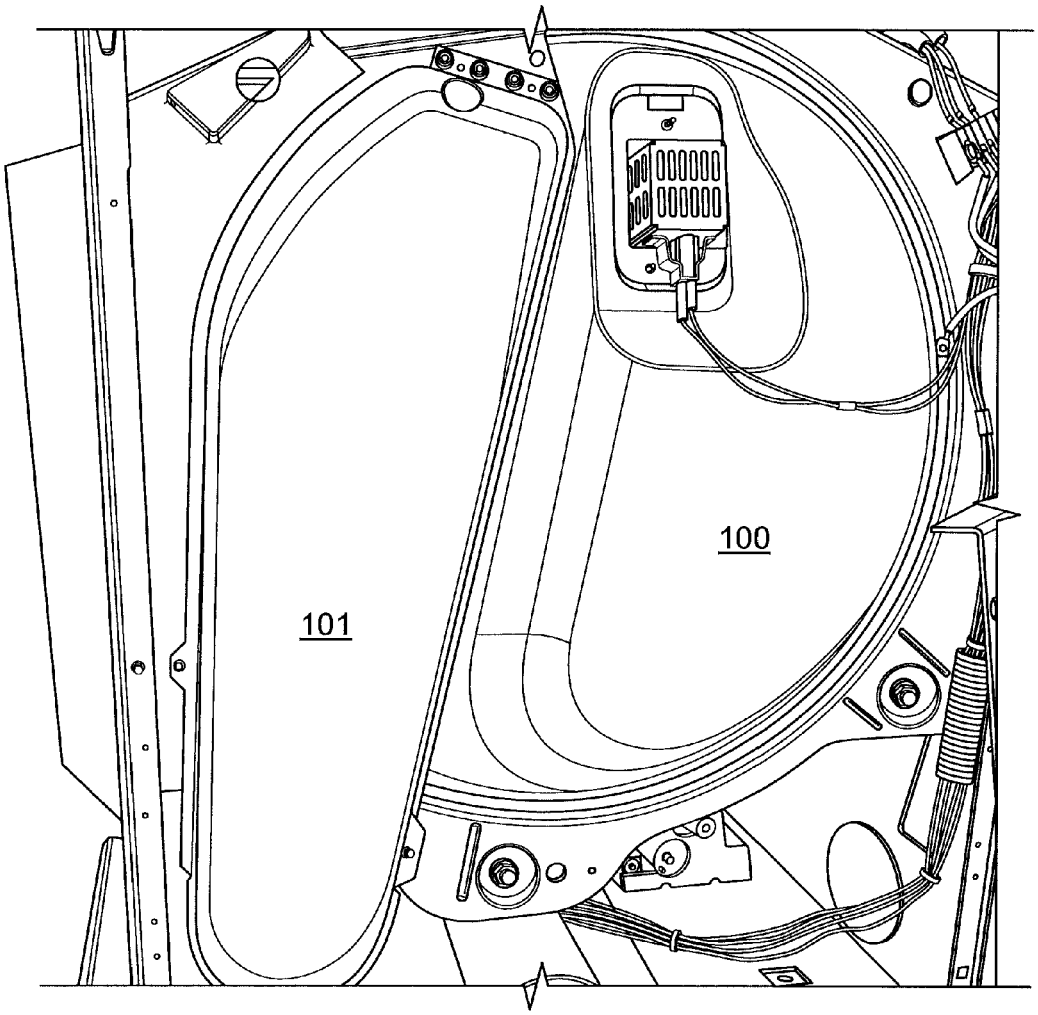
FIG. 12 shows an end view of a prior art clothes dryer.
Figure 13:
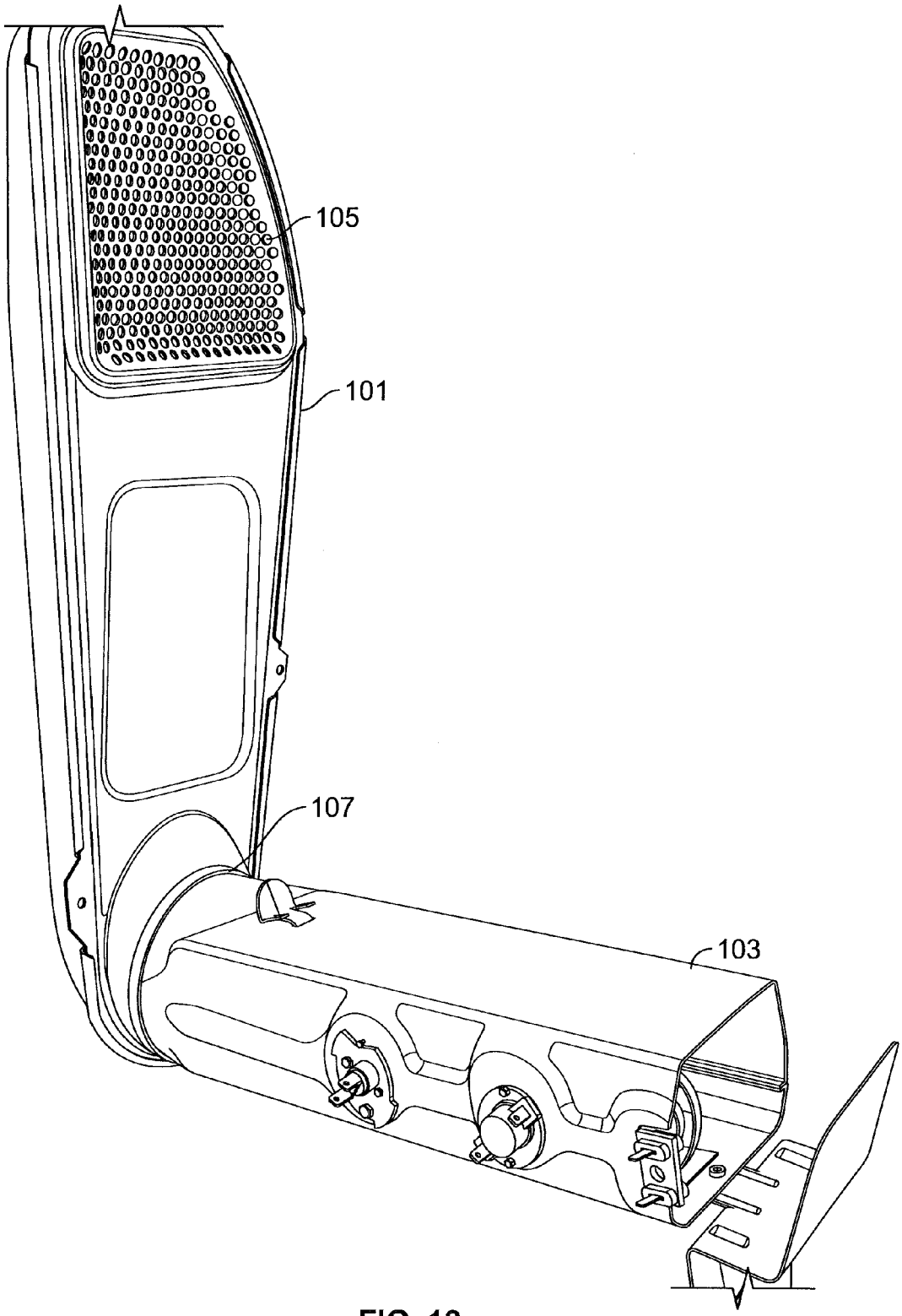
FIG. 13 shows a perspective view of the prior art heater and heater duct of the clothes dryer of FIG. 12.

FIGS. 16*a* and 16*b* show a comparison of the prior art heater duct and the heater duct needed for the inventive heater. FIG. 16*b* shows the same duct 101 shown in FIGS. 12 and 13. FIG. 16*a* shows how the prior art heating duct is modified to work with the inventive heater assembly. Because of the low profile of the heater 10, the heater 10 can be used to replace a portion of the prior art duct 101 and the large and much heavier arrangement of FIG. 13 is eliminated. Thus, the duct 101*a* for the inventive heater is considerably smaller, contributing to less weight and cost for the clothes dryer.

By virtue of the heater assembly's compact design, the heater assembly can replace a vertically aligned portion of the heating duct of the prior art heater, thus providing a much more compact design for dryer manufacture.

The replacement of a portion of the prior art heating duct, i.e., a vertical thin duct normally providing passageway of the heated air from the remote and horizontally inclined heater to the dryer drum, provides significant advantages in clothes dryer manufacture and operation. By incorporating the inventive heater assembly as part of the prior art heating duct, the horizontal heater shown in FIG. 13, its metal shielding, supporting components and associated hardware can be eliminated. Some length of control wire for the heater assembly can also be reduced.

Since the inventive heater assembly is designed such that it forms part of the vertical heating duct used in prior art clothes dryers, the clothes dryer manufacturer can reduce the overall weight of the dryer, thus saving cost. The inventive heater also enables the manufacturer to use less expensive resources, e.g., non-Ni resistance material. Further yet, since the inventive heater operates at lower temperatures than the prior art heaters, the clothes dryer is inherently safer and is more efficient by reducing radiant heat losses.

In use, the heater assembly can be used in any application wherein a fluid such as air needs to be heated. A preferred application is clothes dryers as explained above, but the invention is not so limited to this specific application.

The turn arrangement of the openings shown in FIGS. 4*a*-4*e* is one that could be employed in any heater employing ribbon and mica boards for heating purposes. In the prior art, it is common to merely provide a number of square openings that are arranged in a semicircular path to turn the ribbon from one row to its adjacent row. The design shown in FIG. 4*a*-4*e* provides much less stress to the ribbon when making the turn, thus contributing to the longevity of the heater operation.

In conjunction with any advantages stated above, the inventive heater assembly can be said to have a number of advantages, including the following:

1. Fresh unheated air is delivered at two levels into the heater duct. This enables each section of ribbon elements to receive its own unheated air. The top section or level 31 receives its own unheated air that has not been affected by air preheated by the bottom level or section. Thus, essentially all the air passing through the duct comes in contact with the heating element metal. By using two levels the entire volume of air passing through the duct is covered by the heaters. Two levels allow for the use of two structurally sound small height convolutions to cover the entire duct area rather than one large convolution, which may be prone to movement during operation at the normal high temperatures experienced by heating elements. Further, the resultant heat is spread uniformly over the entire space allowing for more uniform temperatures of operation. Also, the two heater sections may be operated in parallel for reasons enumerated later or may be operated in series.

2. Mica plates with holes appropriately placed may be used to support the heater elements. The elements may be from either side and the metal support plate upon which the mica plates are attached may be formed in the opposite direction to create either left handed or right handed heaters as required. (A mirror image heater to that shown in the drawings and photographs)

3. The heater ribbon is arranged in paths and the direction of a path is reversed at a path end by a unique whole arrangement or pattern. The heating element direction is reversed by a special hole formed using one square hole whose axis is in the direction of the travel of the ribbon and an intersecting square cut at approximately 45 degrees. The second hole in the three-hole turn pattern is a trapezoid shaped hole whose main axis is 90 degrees to the path of the ribbon. The third hole in the three-hole turn pattern is a mirror of the first hole in that it is composed of two intersecting squares set at 45 degrees. These three unique holes allow for the ribbon element pattern to make a, 180-degree change of direction with little or no stress.

4. The ends of the heating elements may be mechanically crimped or welded to terminal tabs or terminal pins for achieving electrical connection to power supply.

5. By making the heater two parallel circuits as in 1 above, an additional advantage of the invention over conventional series or single coil heater is that each ribbon has a higher electrical resistance than a single stage heater. Therefore, each of the ribbon elements is smaller in mass, meaning lower operating watt loading than with a single ribbon heater design. The overall effect is a lower element operating temperature resulting in the entire area of the heating element being cooler than would be the case with a single stage heater occupying the same space. This puts less demand upon the support materials used to retain the heating element materials such as the mica plates and the supporting metals and reduces the chances of problems that can occur during operation such as current leakage to ground associated with excessively high operating element temperatures.

6. Also, because of the advantages above, there is less weight of the heating element material used for the heating element than if a conventional single stage heater is used and this translates into a significant cost saving.

7. Also, the inventive design allows for a non-Ni bearing alloy, e.g., a chromium, iron, aluminum resistance heating material, to be used for the heating element as is customary for such heating applications. This is significant because Ni is a rare and an expensive commodity. Normally, using an iron, chromium, aluminum resistance heating material requires excessive support since this material is much softer at operating temperatures than the Ni material. Thus, cost savings that may be obtained by using the lower cost resistance heating material are lost by having to provide extra support. With the inventive heater and its compact ribbon arrangement and avoidance of excessive heating of the level 31 ribbons, a non-Ni bearing resistance material such as the known iron, chromium, aluminum material can be used without having to provide excessive support. The cooler operating temperature of the heater also contributes to less stress on the ribbons, thus permitting use of the softer resistance heating material.

8. The compact new heater design allows the vertical thin duct normally used only for ducting the air heated by a remote horizontal heater into the back of a clothes dryer cavity section to now accommodate the new heater (see FIGS. 14-16*b*). As can be seen, the new invention allows the complete removal of the aforementioned horizontal heater, its heater duct, the metal support which mounts the open end of the horizontal duct, the metal heat shield, the entire lower end of the vertical duct with the required hole for accepting the end of the horizontal duct, and of course the associated fasteners and labor for the required assembly. Some length of the control wiring routed to the heater can be reduced also. This can result in significant savings from a weight perspective. The amount of weight savings will, of course, vary with the heater application. For examples, in clothes dryers, the weight savings can be significant, but lighter duty applications may not reflect as much weight savings. In any event, the compact design of the heater is an advantage over other designs that are larger in any application. Besides the savings in weight, cost savings can occur in connection with less labor in manufacturing since less weight is involved.

9. Further, the new heater invention is designed such that its metal housing actually forms the lower portion of the vertical duct. The overall effect of the new invention allows a clothes dryer manufacturer to reduce several pounds of metal, utilize a heater using less expensive resources than conventional designs, utilizes a heater that operates at lower temperatures that are safer and have less radiant losses than do conventional designs.

I claim:

1. An electrical resistance heater assembly comprising:

a) a heater housing forming a channel having a longitudinal axis for a fluid to pass through;

b) a heater support plate; and c) a first mica board assembly mounted to the heater support plate at a first level and a second mica board assembly mounted to the heater support plate at a second level, each mica board assembly supporting a heater ribbon running in a looped configuration along rows that are generally perpendicular to the longitudinal axis of the channel; adjacent rows terminating in a plurality of openings configured to turn the ribbon 180 degrees for travel from one row to an adjacent row;

d) wherein the first level is positioned adjacent an inlet of the heater housing and the second level is positioned downstream of the first level, the first level and a side of the heater housing forming a passageway for the fluid to enter the heater housing and be directed to heater ribbons of the second level without having to pass over heater ribbon of the first level.

2. The heater assembly of claim 1, wherein the plurality of openings comprises a pair of first openings and a second opening, each first opening having a first face that is generally perpendicular to an axis of a row in the mica board assembly and a second face that is aligned generally 45 degrees from the axis, and the second opening having opposing faces, each opposing face aligned generally 45 degrees from the axis of the row.

3. The heater assembly of claim 1, wherein the heater support plate has a first plate portion that forms the second level and a pair of flanged legs extending from the heater support plate to form the first level and the passageway.

4. The heater assembly of claim 2, wherein the heater support plate has a first plate portion that forms the second level and a pair of flanged legs extending from the heater support plate to form the first level and a portion of the passageway.

5. The heater assembly of claim 1, wherein the first and second levels each have a heater ribbon, with the heater ribbons connected in parallel.

6. The heater assembly of claim 2, wherein the first and second levels each have a heater ribbon, with the heater ribbons connected in parallel.

7. The heater assembly of claim 3, wherein the first and second levels each have a heater ribbon, with the heater ribbons connected in parallel.

8. In a clothes dryer using an electric resistance heater, the improvement comprising the heater of claim 1.

9. A clothes dryer comprising:

a dryer drum having a generally horizontal axis and a vent to allow heated air to enter the dryer drum for drying purposes;

the heater assembly of claim 1 mounted adjacent the dryer drum in a vertical orientation and having a channel to receive air to heat; and a heating duct arranged in a generally vertical orientation between an outlet of the heater assembly and the vent to direct heated air from the heater assembly to the dryer drum.

10. In a method of heating a fluid using an electrical resistance heater, the improvement comprising using the heater of claim 1.

11. The method of claim 10, wherein the fluid is air.

12. The heater assembly of claim 1, wherein the heater ribbon is made of a non-Ni bearing material.

13. An electrical resistance heater assembly comprising:

a) a heater housing forming a channel having a longitudinal axis for a fluid to pass through;

b) a heater support plate forming first and second levels in the heater housing; and c) a first mica board assembly mounted to the heater support plate at a first level and a second mica board assembly mounted to the heater support plate at a second level, each mica board assembly supporting a heater ribbon running in a looped configuration along rows that are generally perpendicular to the longitudinal axis of the channel; adjacent rows terminating in a plurality of openings configured to turn the ribbon 180 degrees for travel from one row to an adjacent row;

d) wherein the first level is positioned adjacent an inlet of the heater housing and the second level is positioned downstream of the first level, the first level and a side of the heater housing forming a passageway for air to enter the heater housing and be directed to heater ribbons of the second level without having to pass over heater ribbon of the first level;

e) wherein said heater support plate has a first plate portion that forms said second level and a pair of flanged legs extending from the heater support plate to form said first level and said passageway.

* * * * *